US008544150B2

(12) United States Patent
Christie et al.

(10) Patent No.: US 8,544,150 B2
(45) Date of Patent: Oct. 1, 2013

(54) TOP PIN DOOR ASSEMBLY

(75) Inventors: Anthony K. Christie, Wayland, MI (US); John Early, Portage, MI (US)

(73) Assignee: Eliason Corporation, Portage, MI (US)

( * ) Notice: Subject to any disclaimer, the term of this patent is extended or adjusted under 35 U.S.C. 154(b) by 15 days.

(21) Appl. No.: 13/404,497

(22) Filed: Feb. 24, 2012

(65) Prior Publication Data

US 2012/0297578 A1 Nov. 29, 2012

Related U.S. Application Data

(60) Provisional application No. 61/463,985, filed on Feb. 25, 2011.

(51) Int. Cl.
*E05F 1/02* (2006.01)

(52) U.S. Cl.
USPC ..... 16/315; 16/313

(58) Field of Classification Search
USPC ..... 16/312, 313, 280, 293, 309, 315, 16/348, 352, 353; 49/410, 412, 409; 160/330, 160/340, 341, 345–347, 123, 167 R, 167 V, 160/168.1 R, 174 R, 176.1 R
See application file for complete search history.

(56) References Cited

U.S. PATENT DOCUMENTS

| | | | | | |
|---|---|---|---|---|---|
| 377,910 | A * | 2/1888 | Pugh | 16/313 |
| 1,327,045 | A * | 1/1920 | Hughes | 16/313 |
| 1,386,621 | A * | 8/1921 | Hughes | 16/284 |
| 1,630,200 | A * | 5/1927 | Merrill | 49/42 |
| 2,920,340 | A * | 1/1960 | Hopkins | 16/248 |
| 3,160,913 | A * | 12/1964 | Carey | 16/315 |
| 3,289,244 | A * | 12/1966 | Carey | 16/315 |
| 3,313,064 | A * | 4/1967 | Kirby | 49/388 |
| 3,367,613 | A * | 2/1968 | Christensen | 248/145 |
| 3,858,274 | A * | 1/1975 | Burton et al. | 16/312 |
| 4,635,421 | A * | 1/1987 | Newberg | 52/309.11 |
| 5,025,531 | A * | 6/1991 | McCarty | 16/313 |
| 5,613,276 | A * | 3/1997 | Franz | 16/229 |
| 6,161,255 | A * | 12/2000 | Garrett | 16/284 |
| 8,387,210 | B2 * | 3/2013 | Sawa | 16/50 |

OTHER PUBLICATIONS

Easy Swing Installation Instructions, Dec. 2008.*

* cited by examiner

*Primary Examiner* — Jeffrey O Brien
(74) *Attorney, Agent, or Firm* — Miller, Canfield, Paddock and Stone; Mark L Maki

(57) ABSTRACT

An improved top pin assembly is provided for a traffic door which is side-mountable to the door without the necessity of integrated the top pin assembly within the interior of the door panel.

16 Claims, 15 Drawing Sheets

FIG. 11
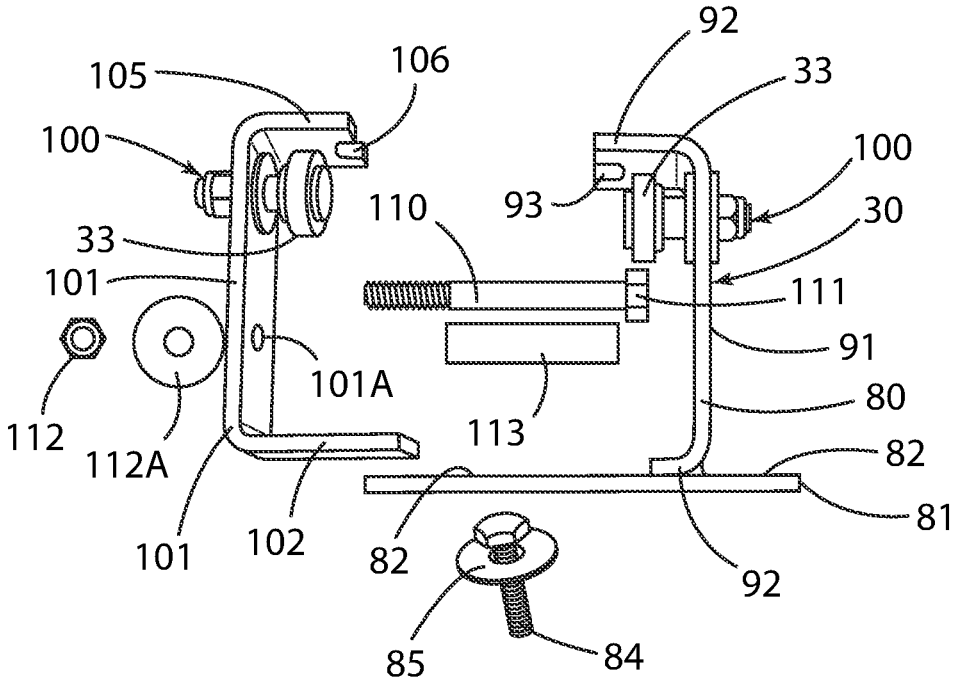
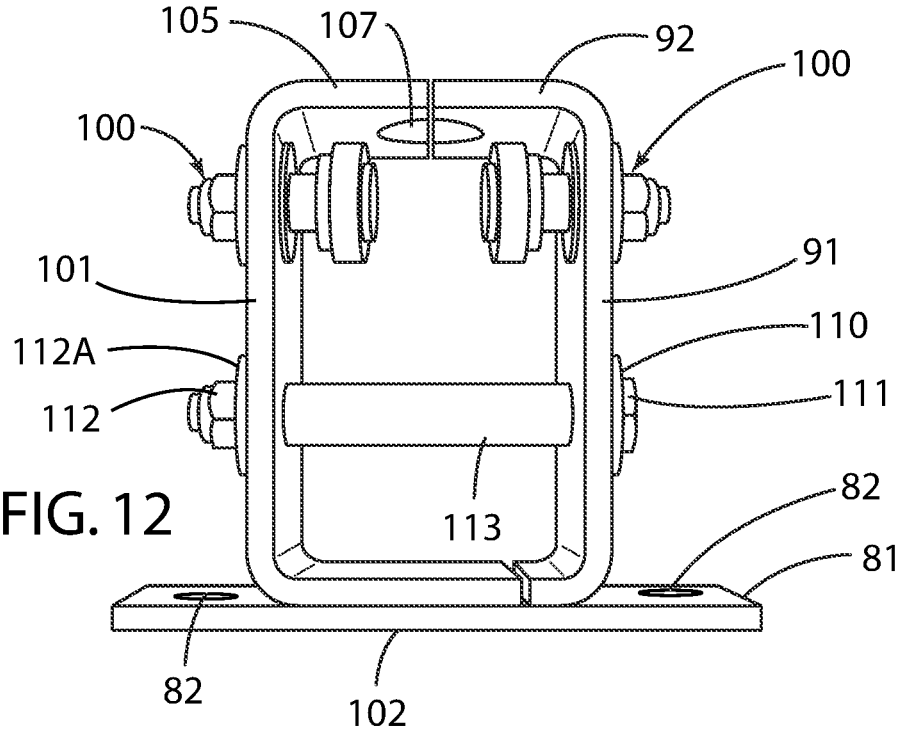
FIG. 12

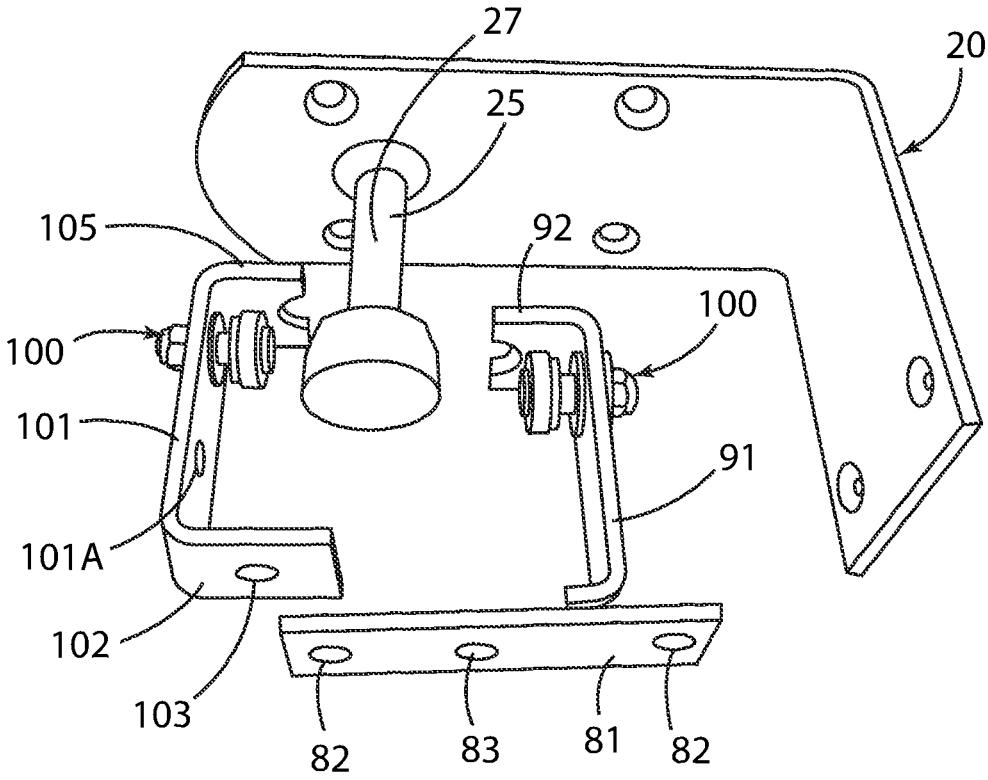
FIG. 14
FIG. 15
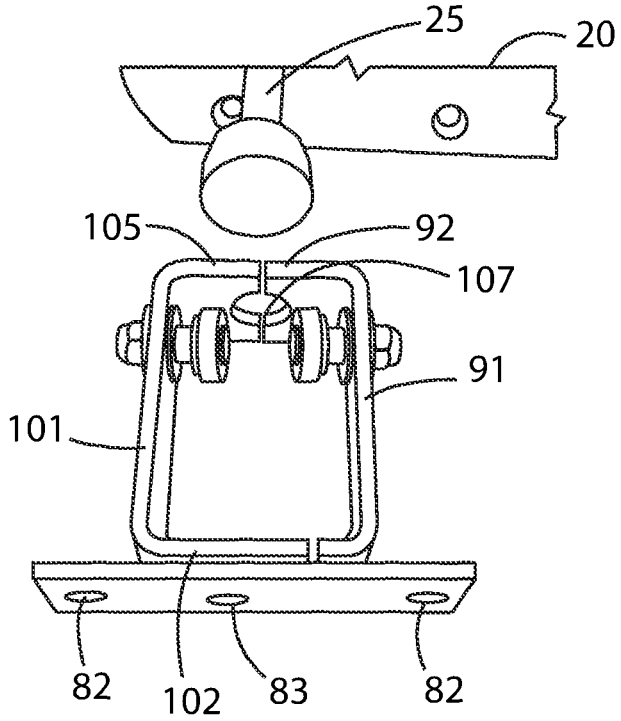

FIG. 18
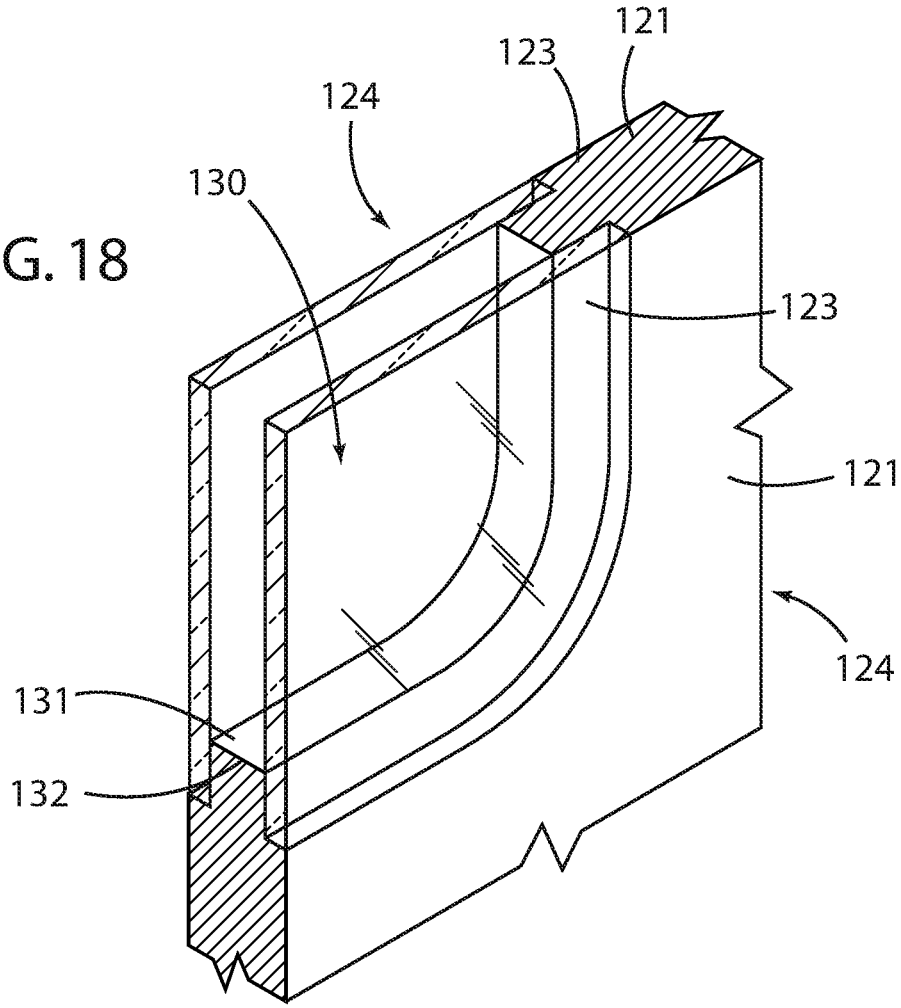
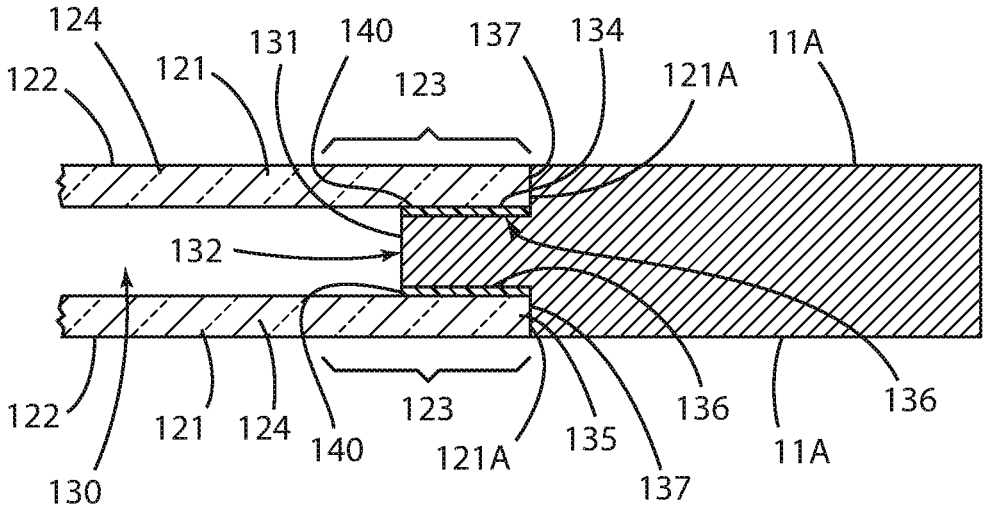
FIG. 19

TOP PIN DOOR ASSEMBLY

CROSS REFERENCE TO RELATED APPLICATIONS

This application claims priority of U.S. Provisional Patent Application No. 61/463,985, filed Feb. 25, 2011, the disclosure of which is incorporated herein by reference in its entirety.

FIELD OF THE INVENTION

The invention relates to a top pin assembly for a swinging door.

BACKGROUND OF THE INVENTION

Traffic doors are typically used in commercial establishments to allow two-way traffic through a doorway. Such doors may be used in a variety of such establishments including supermarkets, restaurants, retail stores, hospitals, walk-in coolers, etc.

The doors may be provided singly or in pairs, and mount to a door frame by hinges which allow the doors to freely swing in opposite directions, i.e. both inwardly into a room and outwardly from the room. In a commercial establishment, this allows employees to freely move between two adjacent rooms merely by pushing on the freely, swingable doors wherein the doors automatically return to the closed position without any further action from the employee, which thereby facilitates the traffic flow of employees from room to room.

More particularly, such traffic doors also have a hinge arrangement connecting each door to a door frame which allows the doors to swing in opposite directions, but also gently closes or returns the door to a closed or "rest" position blocking the doorway. Examples of such a hinge assembly are disclosed in U.S. Pat. Nos. 3,160,913 and 3,289,244, which patents were obtained by the assignee of the present invention. The disclosures of these patents are incorporated herein by reference in their entirety. These hinge assemblies operate to close the door without the need for a spring arrangement that would generate a spring force to bias the doors to a closed position. Rather, the hinge assemblies disclosed in these patents use a roller assembly which generates a closing action on the doors by gravity acting upon the door itself.

A specific example of such traffic doors is the family of doors sold by the present assignee, namely Eliason Corporation, under its EASY SWING® trademark.

It is an object of the invention to provide an improved door assembly of this general type which incorporates an improved hinge assembly which has a side-mount construction mountable to a single face of a door.

The invention relates to an improved door assembly of the type which positively restrains the door in a normally closed position. The door assembly preferably includes an improved top pin assembly which is mountable to one side of the door without the necessity of notching or cutting the door panel. The hinge assembly is partially pre-assembled with an upper bracket assembly pre-assembled to a top hinge pin prior to mounting of the door. While the bracket assembly will move in unison with the door, it is initially pre-mounted to the hinge pin and suspended therefrom, and then is engaged with a side-mounted base bracket already fixed on the door so that base bracket and upper bracket assembly are affixed together on the door and allow for rotation of the door relative to the hinge pin. This provides for ease of assembly, and provides a side mounted top pin assembly which is not visible from one side of the door.

Other objects and purposes of the invention, and variations thereof, will be apparent upon reading the following specification and inspecting the accompanying drawings.

BRIEF DESCRIPTION OF THE DRAWINGS

FIG. 11 is an exploded view of an upper bracket assembly.

FIG. 12 is an assembly view thereof.

FIG. 14 is an exploded view of the upper bracket assembly prior to mounting to the hinge pin.

FIG. 15 is an exploded view of the upper bracket assembly and hinge pin.

FIG. 18 is an enlarged perspective view of the frameless window.

FIG. 19 is an enlarged cross-sectional view of the window and door.

Figure 1:
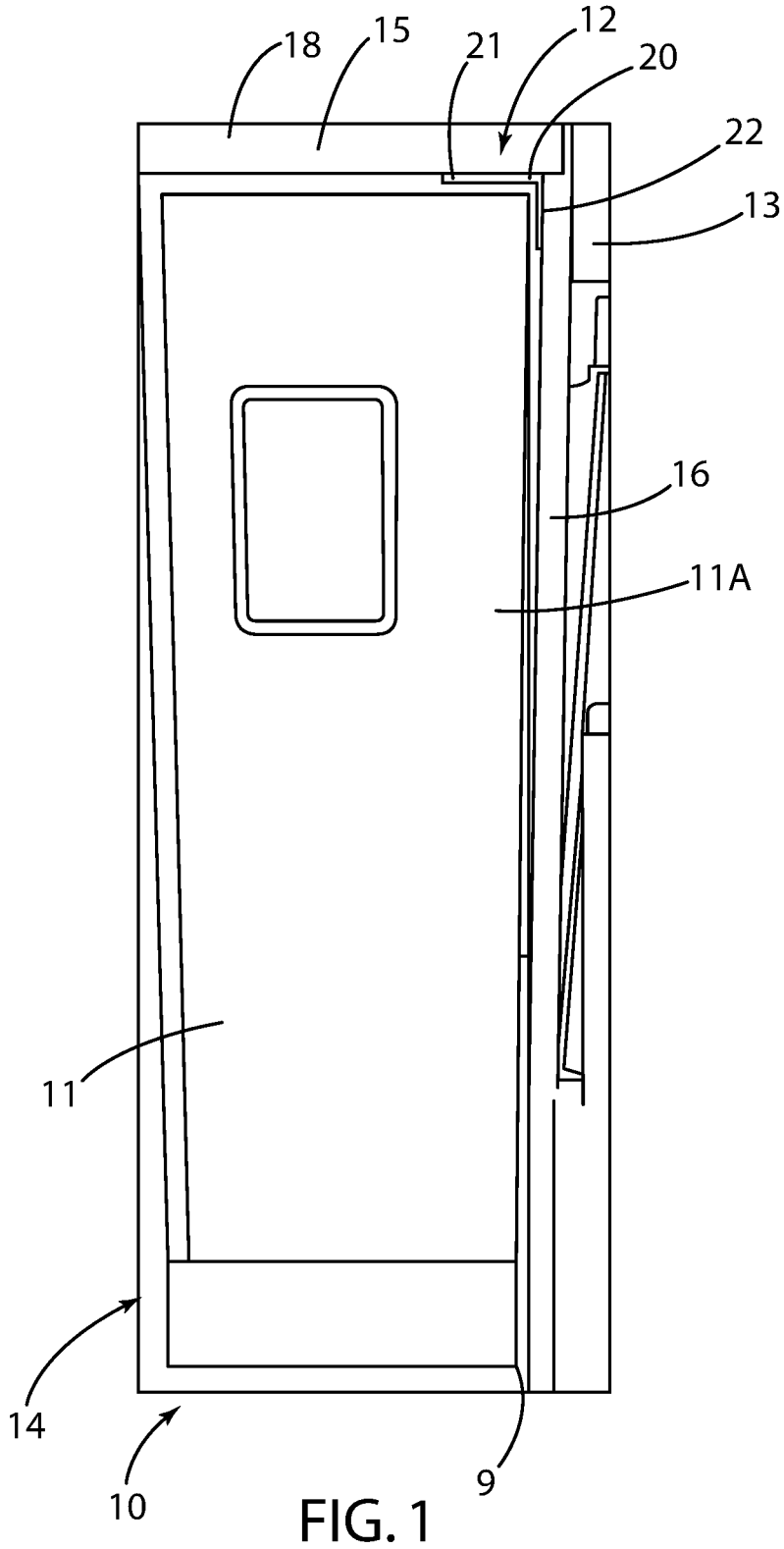
FIG. 1 is a perspective view of a door assembly.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
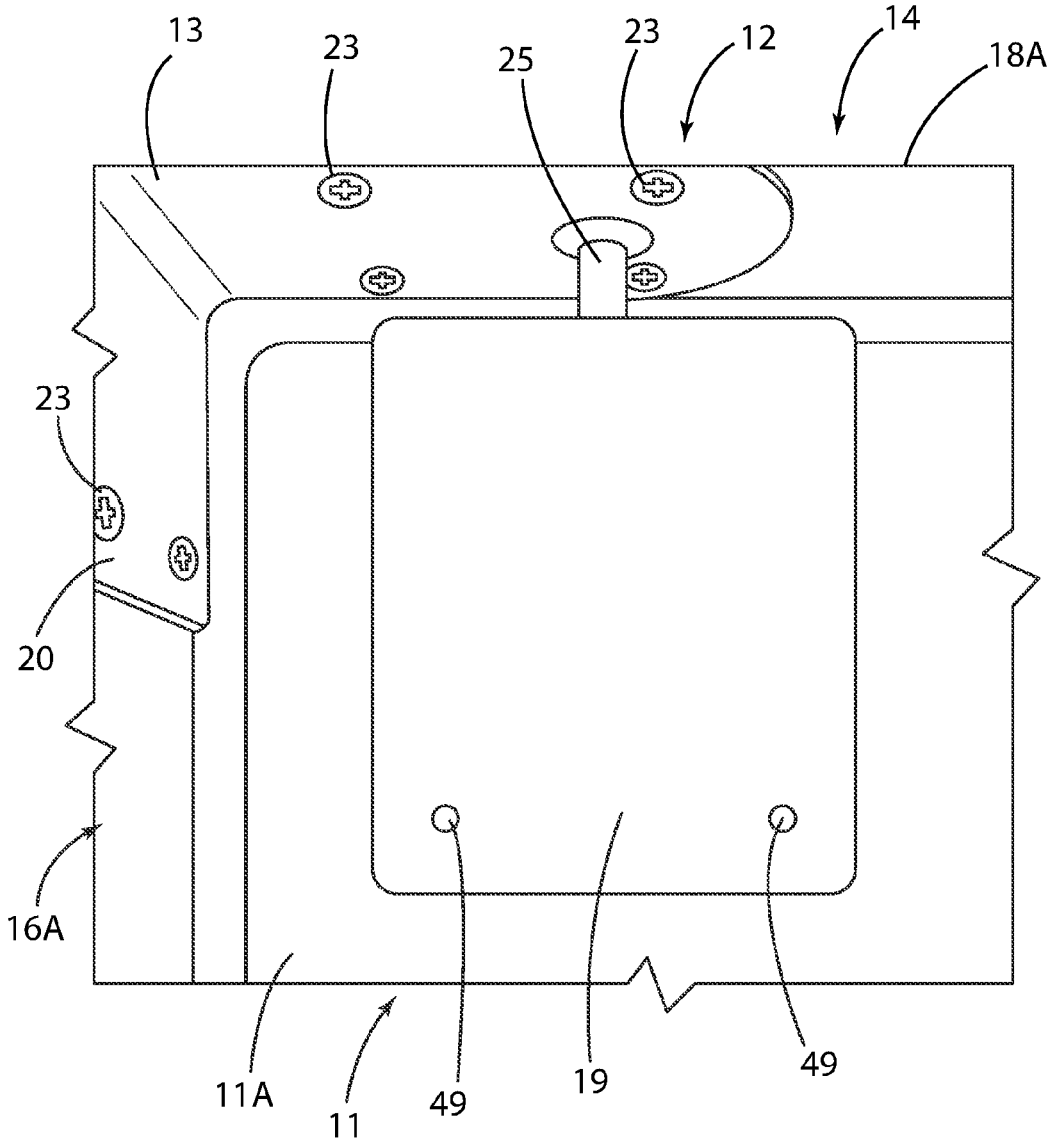
FIG. 2 illustrates one face of the door assembly with a covered top pin assembly.
Figure 7:
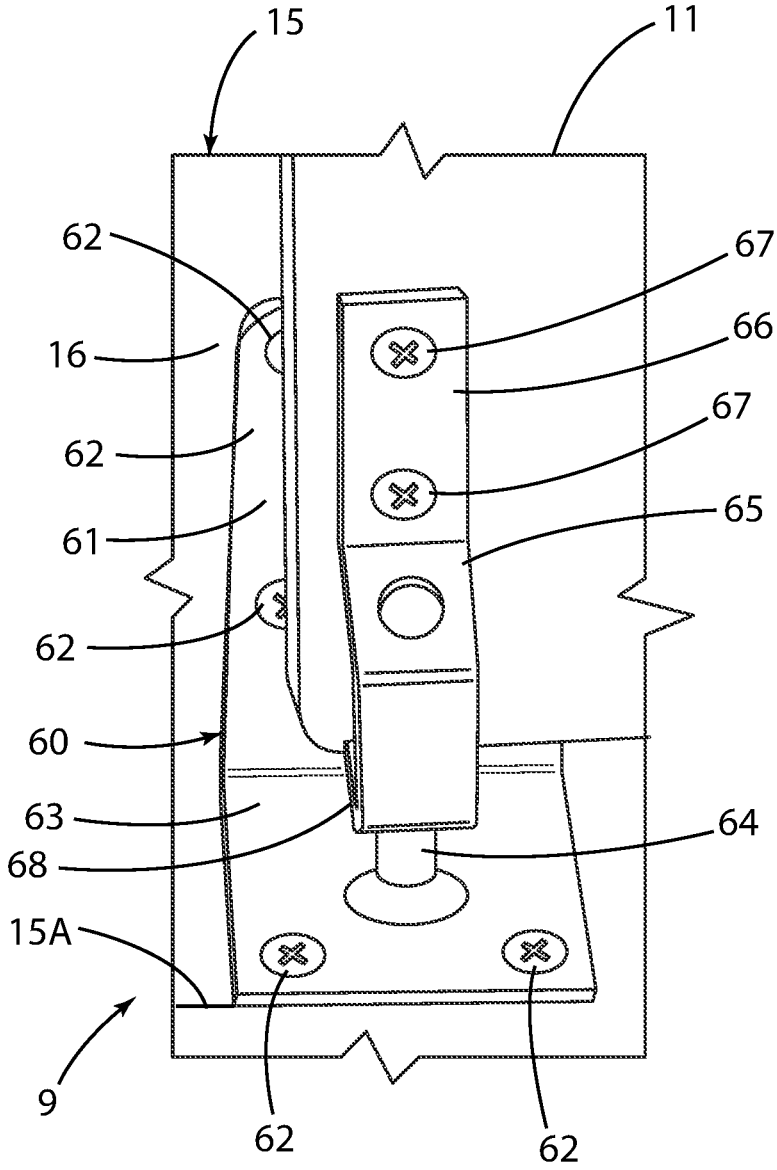
FIG. 7 illustrates a bottom corner of the door.

Referring to FIGS. 1 and 2, an improved door assembly 10 comprises a panel-like door 11 which is connectable by bracketry, namely a top pin assembly 12 and a lower bracket 9 (FIGS. 1 and 7), which mount to the frame 13 of a doorway 14. More particularly, the doorway 14 typically extends through a partition wall 15 such as the wall of a building or the wall of a cooler. The doorway 14 is defined by a bottom threshold or floor 15A (FIG. 7), upright door jambs 16 and a crosswise header 18. The jambs 16 and the header 18 typically have a side-to-side width which is defined by the thickness of the partition wall and has a conventional rectangular shape.

As seen in FIG. 2, the top pin assembly 12 connects to the respective inside faces 16A and 18A of one of the jambs 16 and the header 18, and to only one face 11A of the door 11. The door 11 is pivotally connected to such top pin assembly 12 to permit swinging movement of the door 11 in opposite swinging directions. As such, the top pin assembly 12 permits bi-directional swinging movement of the door 11 between the closed position of FIGS. 1-3 and a first open position of FIG. 4 wherein the door is at a right, 90 degree angle relative to the closed position.

Figure 3:
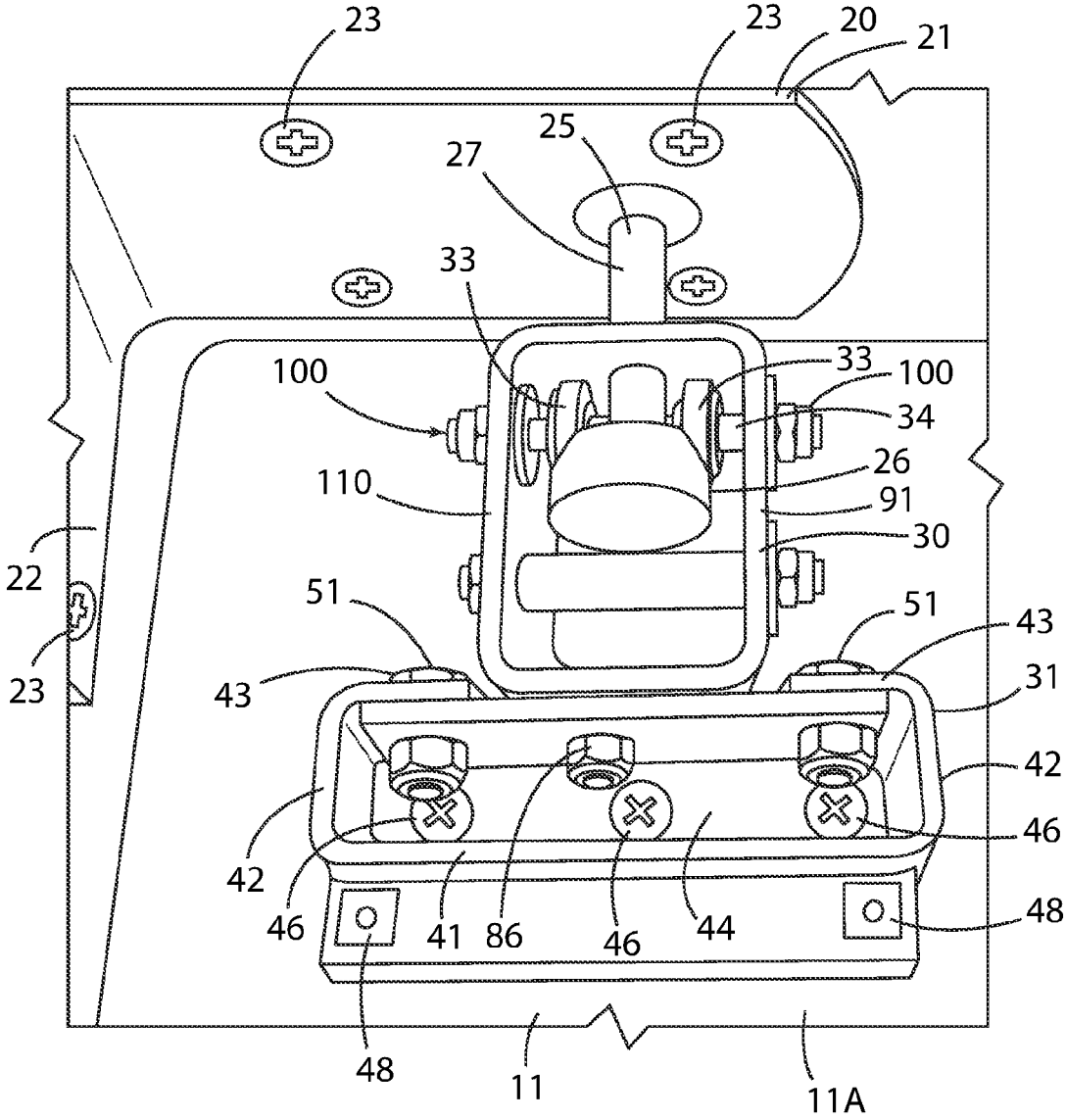
FIG. 3 illustrates the top pin assembly with the cover removed and the door in a closed position.

As seen in FIG. 1, the door 11 includes the top pin assembly 12 in the upper corner thereof which cooperates with the door frame to effect a self-centered closing of the door 11 so as to generally be centered within the doorway 14 widthwise of the partition wall in the closed position of FIG. 1. The top pin assembly 12 comprises a box-like cover 19 (FIG. 2) which provides selective access to the top pin assembly 12 so that it is accessible from the one side of the door as seen in FIGS. 2-4.

Figure 4:
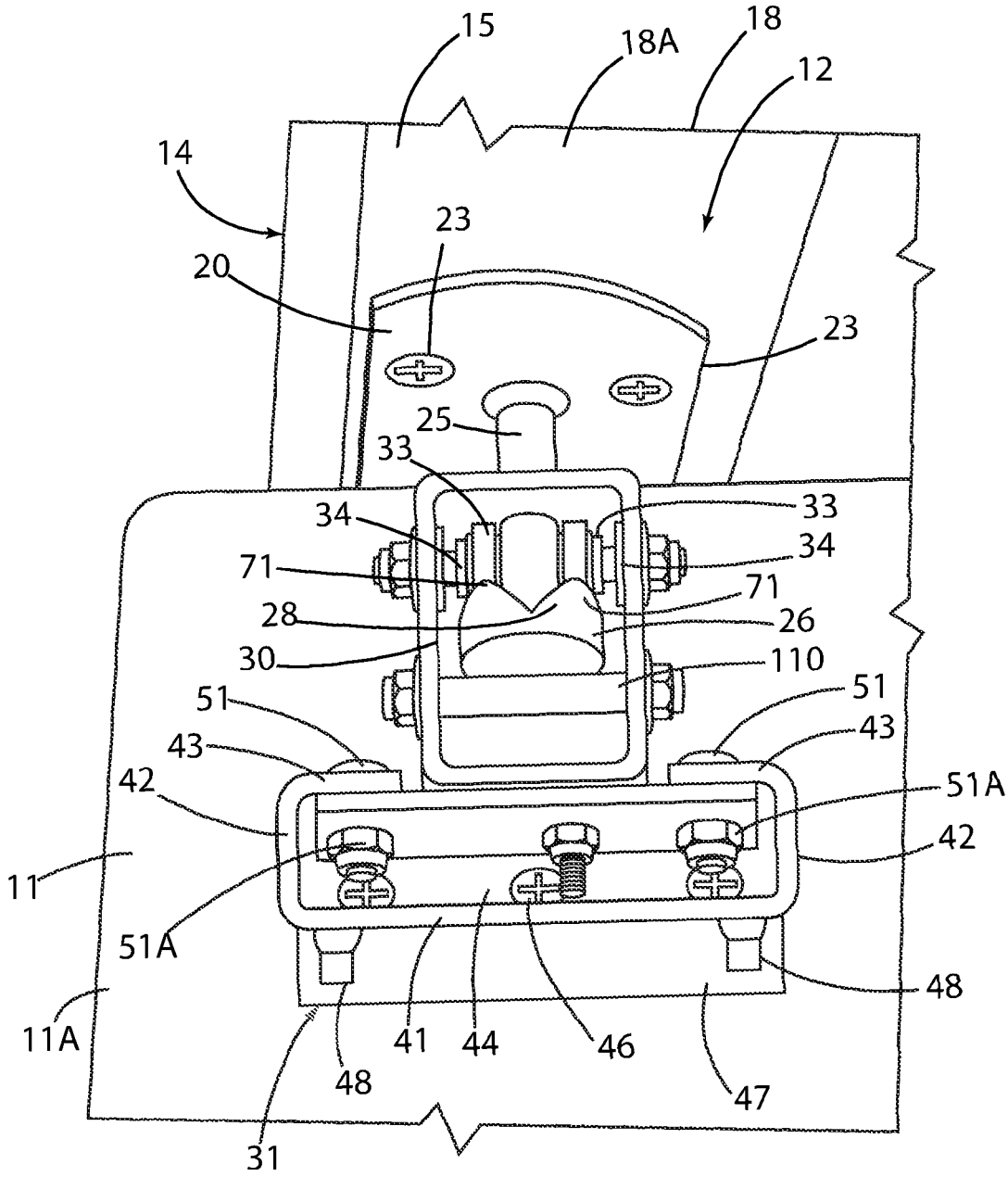
FIG. 4 illustrates the top pin assembly with the door in an open position.

The top pin assembly 12 not only biases the door 11 to the closed position of FIG. 1, but also permits the door 11 to open in either the first open position of FIG. 4 or a second open position wherein the door is oriented 180° relative to the first open position. In this second open position, the door is still oriented at the right, 90° angle relative to the closed position (FIG. 1) after the door 11 has been swung in the opposite direction.

More particularly as to the top pin assembly 12, the top pin assembly 12 (as seen in FIGS. 1-3 and 8) first comprises a hinge bracket or support bracket 20 which comprises a horizontal leg 21 and a vertical leg 22 which are respectively secured to the header 18 and jam 16 by suitable fasteners 23, which are preferably screws. The hinge bracket 20 includes a downwardly extending, fixed hinge post or pin 25 which is preferably welded to the horizontal bracket leg 21.

The bottom or terminal end 24 of the hinge pin 25 includes a support head 26 which is enlarged relative to the shaft 27 of the pin 25 to define an upward-facing, annular support surface or ledge 28 which is configured to rotatably support the weight of the door 11 thereon.

Generally, the top pin assembly 12 further comprises an upper bracket assembly 30 which is affixed to the door face 11A by a base bracket 31. The upper bracket assembly 30 comprises a pair of diametrically opposed rollers 33 located on diametrically opposite sides of the pin 25. The rollers 33 are each rotatably supported upon a respective shaft 34 carried on the bracket assembly 30, wherein the free ends of the shafts 34 each support a respective one of the rollers 33 thereon.

The pin 25 thereby extends downwardly in a vertical orientation and rotatably carry the rollers 33 thereon and in turn supports the upper bracket assembly 30 on the pin 25. The hinge bracket 20 and hinge pin 25 thereby remain in stationary fixed positions during use while the upper bracket assembly 30 rotates together with the door 11 to which it is affixed. As will be described hereinafter, the upper bracket assembly 30 and the remaining components of the top pin assembly 12 described below are rotatably suspended from the top pin 25 by the rollers 33 and are fastened to the door 11, which thereby allows the door 11 to swing between the open and closed positions.

Figure 6:
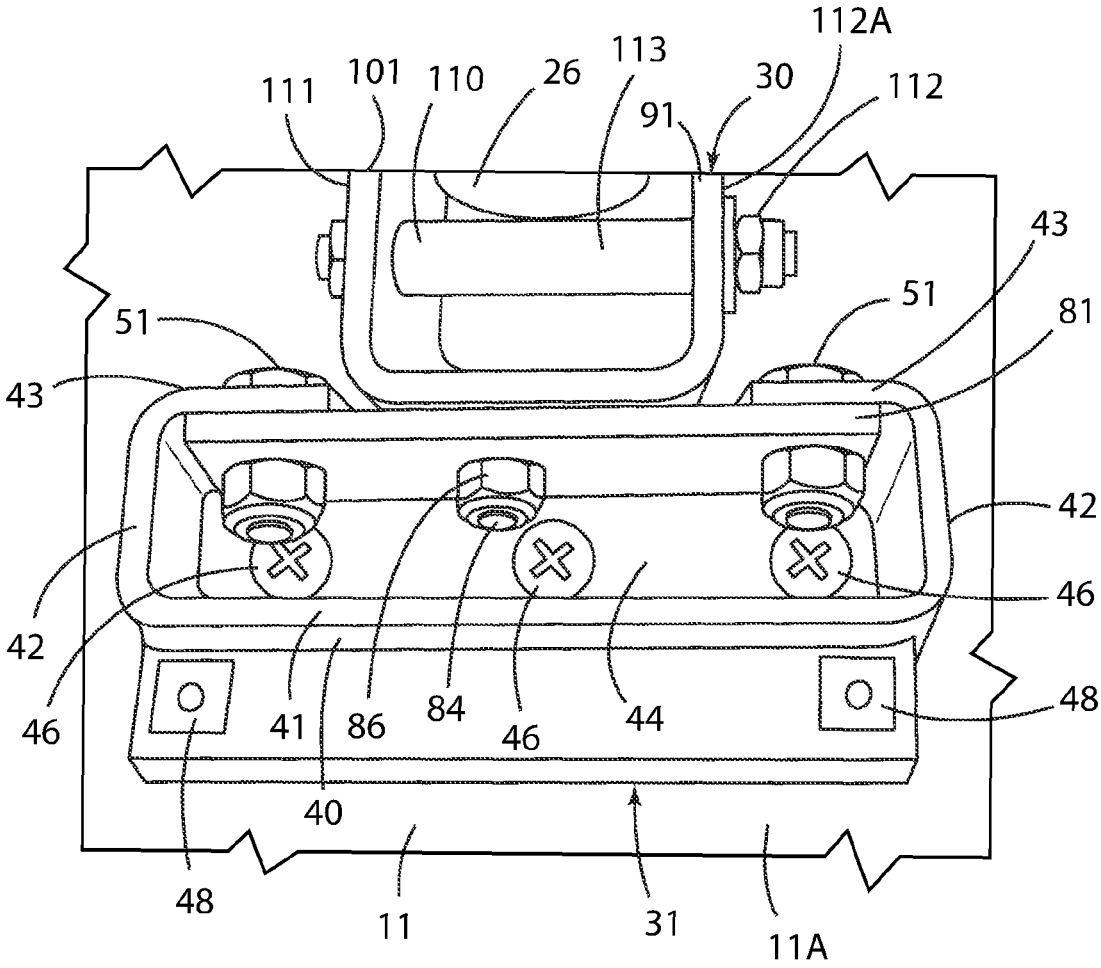
FIG. 6 is an alternate enlarged view of the lower portion of FIG. 3.

Referring to FIGS. 3, 4 and 6, the base bracket 31 includes a generally C-shaped bracket wall 40 comprising a bottom wall 41, side walls 42 and inturned support flanges 43, which flanges 43 define a space therebetween to accommodate the upper bracket assembly 30. The bracket wall 41 includes a back wall 44 which faces the door face 11A for abutment therewith and is fastened or affixed to the door face 11A by fasteners 46. The base bracket 31 therefore is stationarily affixed to the door 11 prior to mounting of the door 11 on the support bracket 20 as will be described further.

The bottom bracket wall 41 also includes a downwardly-depending connector flange 47 having fastener inserts 48 to which the cover 19 (FIG. 2) is affixed by appropriate fasteners 49 (FIG. 2).

To connect the upper bracket assembly 30 to the base bracket 31, the bracket wall flanges 43 include bore holes through which threaded bolts 51 are provided. The bolts 51 are used to join the upper bracket assembly 30 to the base bracket 31 as the door is being suspended from the upper bracket assembly 30. In this regard, it has been previously noted that the upper bracket assembly 30 is pre-mounted to the hinge pin 25 in a sub-assembly that is affixed to the door frame by fastening of the support bracket 20 to the door frame. During this initial installation step, the bracket assembly 30 would then be supported on the door frame due to the bracket assembly 30 being pre-assembled with the support pin 25. The bracket assembly 30 is not yet affixed to the door 11.

For mounting on the door 11, the upper bracket assembly 30 is then preliminarily engaged with the base bracket 31 and then is affixed thereto by the fasteners 51. In this manner, the door 11 is pre-mounted on the top pin assembly 12.

To secure the bottom of the door 11, the bottom hinge assembly 60 (FIG. 7) is provided. The bottom hinge assembly 60 comprises an L-shaped mounting bracket 61 comprising a vertical leg 62 and a horizontal leg 63 which affixes to the door frame 16 and/or floor 15A by suitable fasteners 62. This bottom bracket 61 includes an upstanding hinge pin 64 which generally has a constant diameter cylindrical shape which engages a bottom door bracket 65. The bottom door bracket 65 comprises a mounting leg 66 which is affixed to the door by fastener screws 67. The lower bracket 65 then is bent outwardly and downwardly and then is turned back horizontally to define a bottom leg 68 formed with a vertical bore which rotatably receives the bottom hinge pin 64 therethrough. The bracket 65 restrains the door 11 relative to a vertical axis extending through the bottom pin 64 and the upper pin 25, which are vertically aligned with each other, so that the door will rotate or swing about this vertical axis. Thus, the lower bracket 65 restrains the bottom door sidewardly relative to the pin 64 while permitting relative rotation therebetween. Also, the bracket 65 is displaceable vertically with the door 11 relative to the bottom pin 64 to allow the top pin assembly 12 to function as will be described hereinafter.

Figure 8:
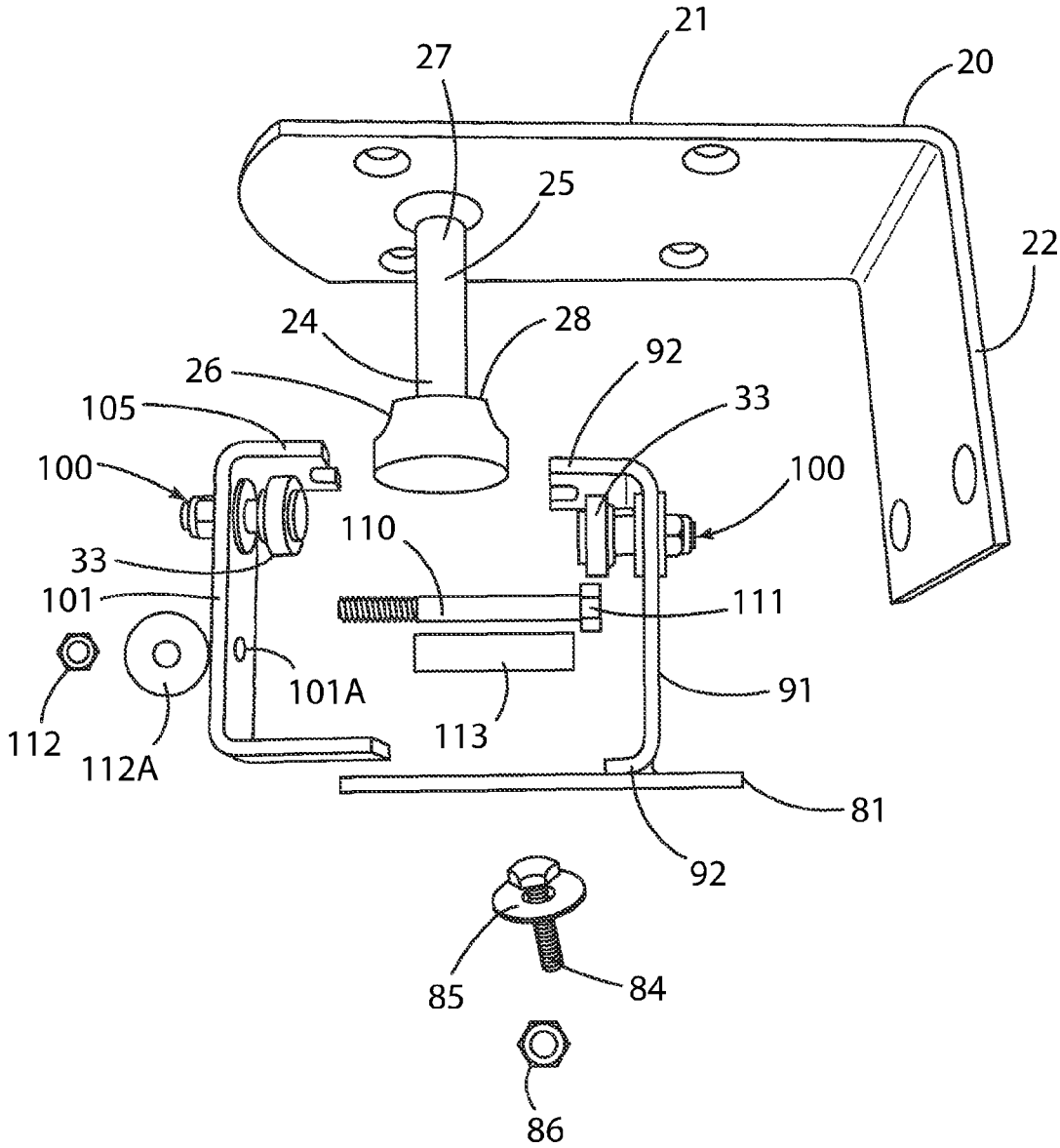
FIG. 8 is an exploded perspective view of the components of the top pin assembly.
Figure 9:
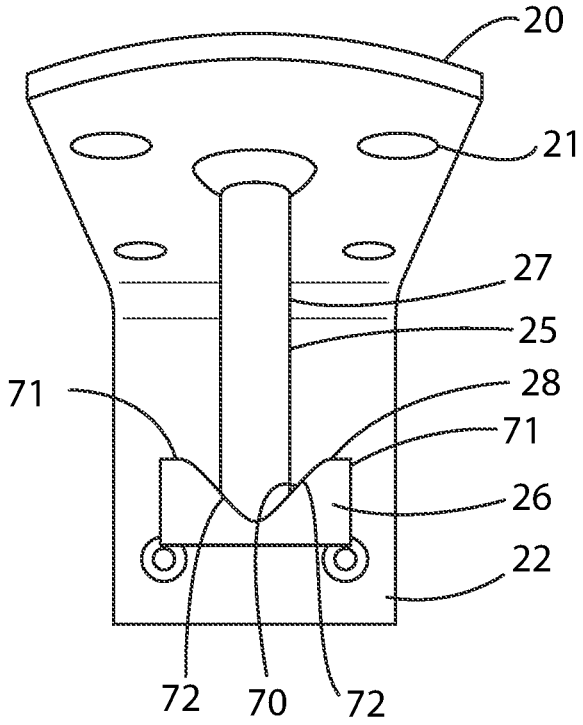
FIG. 9 is a bottom perspective view of a door bracket with a hinge pin.
Figure 10:
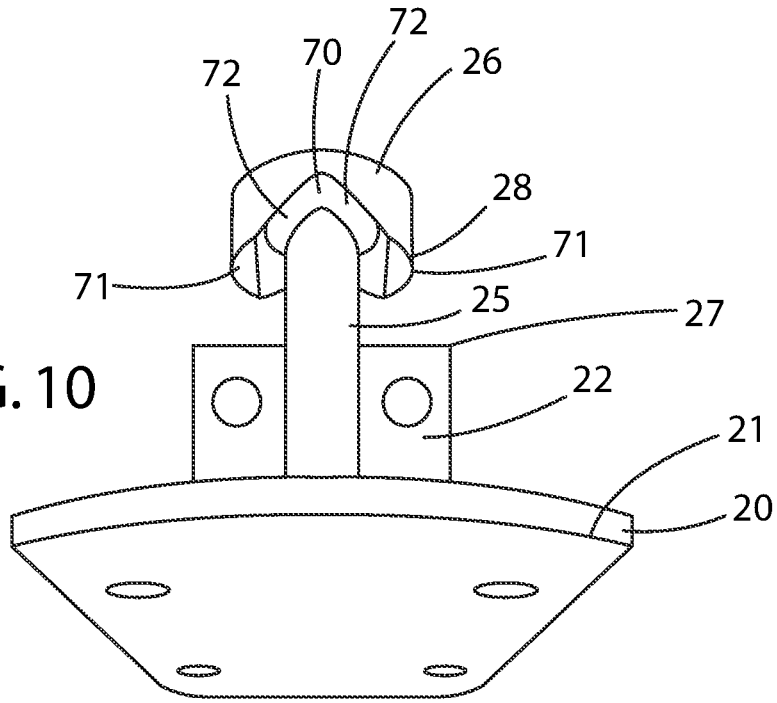
FIG. 10 is an inverted top perspective view of the door bracket.

Referring to FIGS. 8-10, the top support bracket 20 is shown in greater detail. In this regard, the support head 26 is formed with the support ledge 28. This support ledge 28 preferably is formed with a pair of V-shaped notches 70 which extend across the diameter of the support head 28 but rise vertically to raised shoulders 71. When the door 11 is in the closed position of FIGS. 3 and 5, the rollers 33 seat within the centering notches 70 which allows the door to drop vertically downwardly into the notches 70. However, during rotation of the door 11, the rollers 33 roll up the inclined faces 72, which define the notches 70, which thereby causes the door 11 to rise vertically and ultimately allow the rollers 33 to rest upon the raised shoulder 71 when the door is in the open position of FIG. 4. Hence, the door 11 has some vertical displacement as the rollers 33 travel circumferentially about the support shoulder 28 during door rotation. Essentially, the notches 70 provide positive restraining of the door 11 in the closed position and perform a self-centering of the door 11 and automatic return of the door 11 to this closed position as the rollers 33 roll back down the inclined faces 72 of the notches 70.

Figure 13:
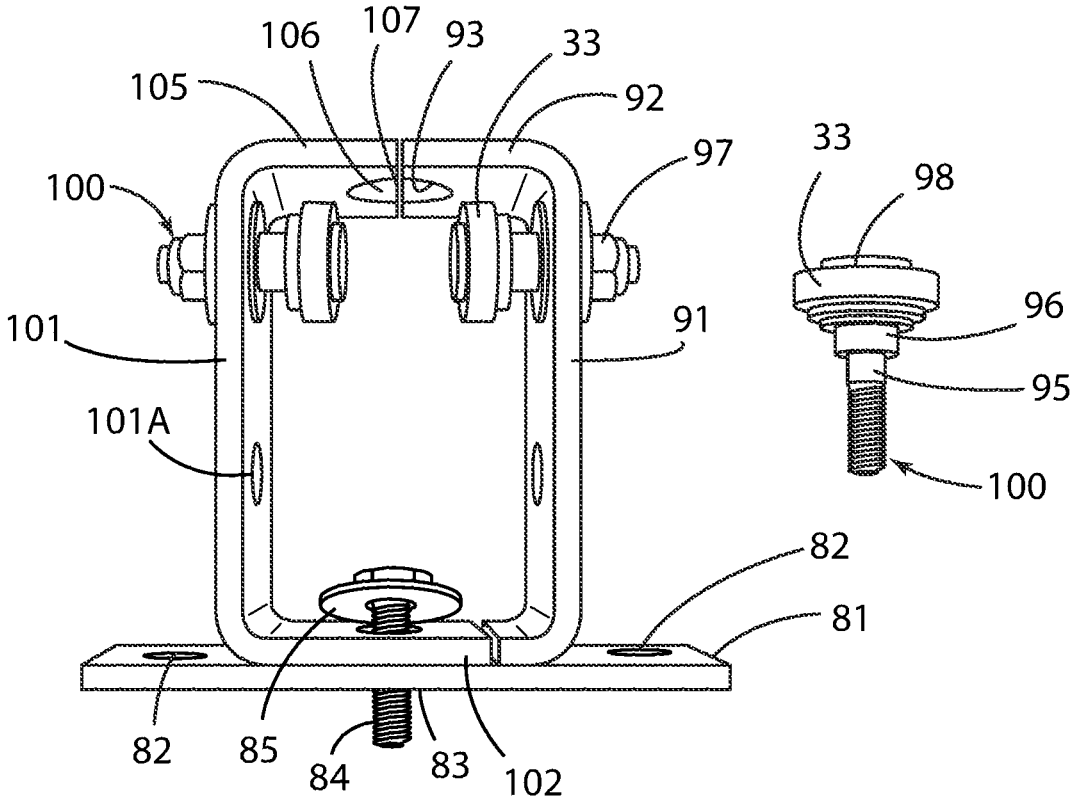
FIG. 13 illustrates the upper bracket assembly and a roller unit mounted thereon.

Referring to FIGS. 11-13, the upper bracket assembly 30 is illustrated in exploded and assembled conditions. The upper bracket assembly 30 preferably comprises a primary support bracket 80 which is formed with a bottom support plate 81 that is adapted to be positioned below and span the gap between the base bracket wall flanges 43 described above in FIG. 4. This support plate 81, when seated below the base bracket flanges 43, thereby allows the door 11 to be suspended on this support plate 81. The support plate 81 is provided with a pair of bore holes 82 through which the fasteners 51 are inserted and secured with the associated nuts 51A. The support plate 81 also includes a central bore 83 which is configured to receive a bolt 84 vertically therethrough as generally seen in FIGS. 11, 13, 16 and 6. The bolt 84 is provided with an associated washer 85 and lock nut 86.

Next, the support plate 81 is provided with a fixed side bracket 91 having an inturned lower end 92 that is welded or rigidly affixed to the support plate 81. The side bracket 91 extends vertically upwardly and turns inwardly to define a top flange 92. The top flange 92 includes a semi-circular notch 93 that is provided so as to extend about the pin shaft 27 and prevent removal of the upper bracket assembly 30 from the hinge pin 25.

The side bracket 91 is also formed with a hole for rotatably mounting the roller 33 thereon near the upper end thereof. As seen in FIG. 13, the roller comprises a main shaft 95 which includes an annular shoulder 96 that is fixed against an inside face of the side bracket 91 and secured in place by a roller nut 97. Appropriate washers are provided between the nut 97 and shoulder 96 and the opposing faces of the side bracket 91 so that the roller shaft 95 is nonrotatably affixed to the side bracket 91. The roller 33 is loosely fitted on the shaft 95 and prevented from falling off by the enlarged head 98 of the shaft 95. The roller 33 is essentially provided with the shaft 95 in a pre-assembled condition as seen in FIG. 13 and then fastened in place with the appropriate washers by the nut 97. This defines a roller assembly 100 that mounts to the side bracket 91.

Figure 16:
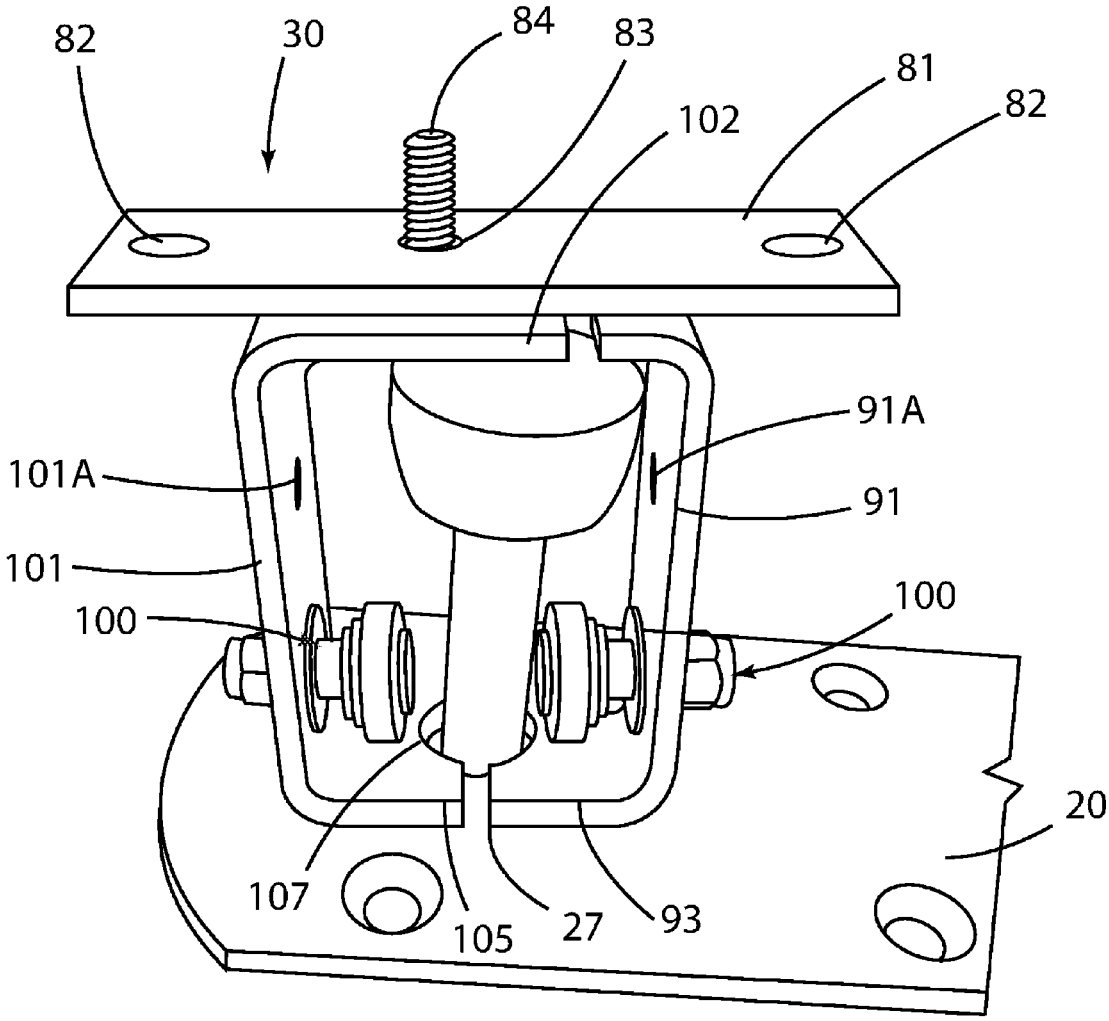
FIG. 16 illustrates the upper bracket assembly mounted to the hinge pin.

A second side bracket 101 is provided which also is provided with its own roller assembly 100 that mounts thereto in the same manner. To affix the second side bracket 101 in place, the side bracket 101 includes a bottom connector flange 102 (FIGS. 13 and 14) which is formed with a bore hole 103 that aligns with the fastener hole 83 of the above-described support plate 81. This connector flange 102 then fits onto the top of the support plate 81 as seen in FIG. 13 to allow the fastener 83 to extend vertically downwardly therethrough as seen in FIGS. 13 and 16 so that the bolt 83 maintains these components in alignment and is provided to secure these components together.

In particular, when the side brackets 91 and 101 are both provided together as seen in FIG. 13, the fastener 84 extends through the bracket bore hole 103 and the plate bore hole 83 so that these components can be subsequently and tightly joined together by the nut 86 as seen in FIG. 6. When the fastener 84 is tightly engaged therebetween, the side brackets 91 and 101 are affixed in non-movable positions in the mated condition of FIGS. 13 and 15. However, by removal of the fastener 84, the two side brackets 91 and 101 are separable as seen in FIGS. 11 and 14.

Figure 5:
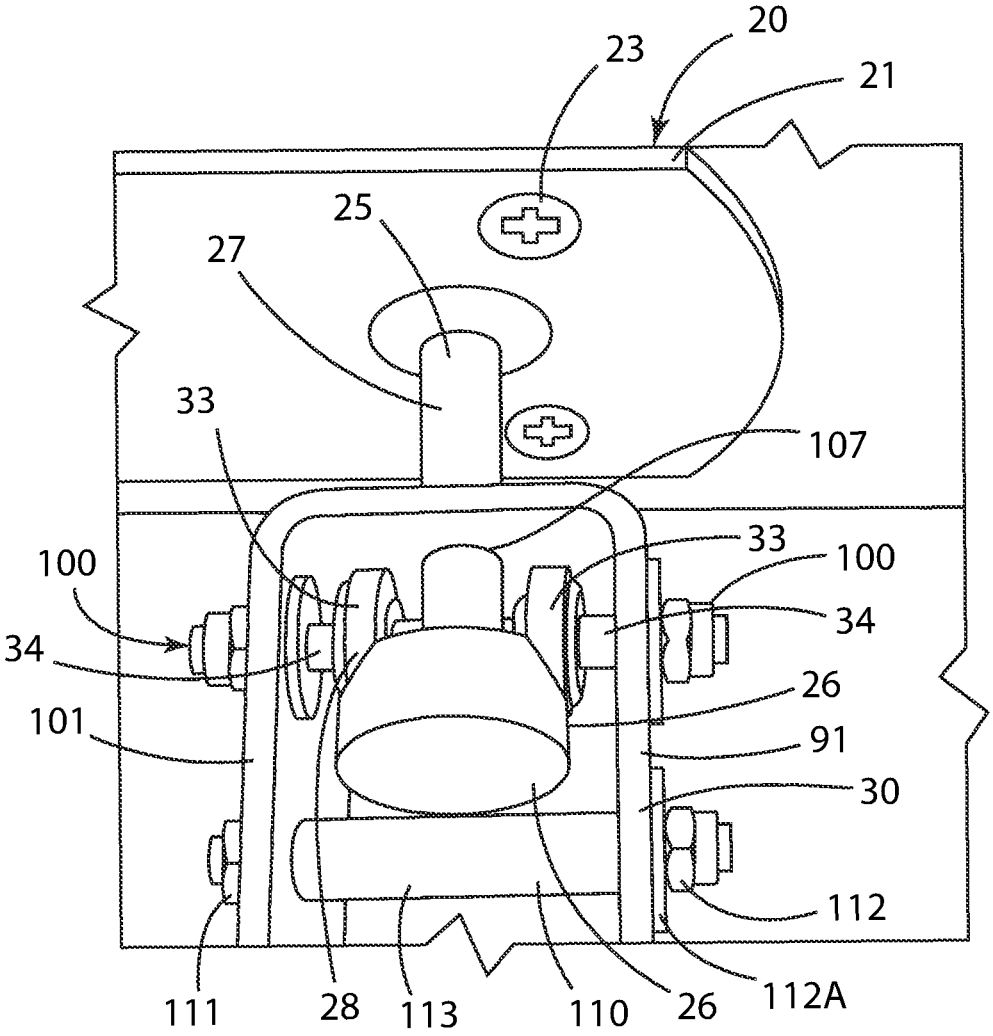
FIG. 5 is an enlarged view of the upper portion of FIG. 3.

Notably, the side bracket 101 also includes a top flange 105 which is formed with a semi-circular notch 106 that aligns with the aforementioned notch 93 in the side bracket 91. These aligned notches 93 and 106 thereby define a circular hole 107 through which the pin shaft 27 extends vertically as seen in FIGS. 5 and 16. When assembling the upper bracket assembly 30 to the hinge pin 25, the side brackets 91 and 101 are positioned on opposite sides of the pin 25 as seen in FIG. 14. These side brackets 91 and 101 are then moved together as seen in FIGS. 15 and 16 with the pin shaft 27 extending through the bracket hole 107 as seen in FIG. 16. FIG. 16 shows the side brackets 91 and 101 in a loose condition, but it is understood that these two brackets 91 and 101 are then rigidly affixed together by the fastener 84 which would thereby non-removably engage the entire upper bracket assembly 30 in suspended relation on the hinge pin 25.

To provide additional support to this structure, particularly under door loads, a cross bolt 110 (FIGS. 5, 6 and 8) is provided to draw the side brackets 91 and 101 together. The draw bolt 110 includes a head 111 at one end and a nut 112 at the opposite threaded end. A plastic sleeve 113 is provided to prevent the brackets 91 and 101 from bowing inwardly toward each other, and the bolt head 111 and nut 112 along with the associated washer 112A prevent the side brackets 91 and 101 from bowing outwardly relative to each other. To receive the draw bolt 110, the side brackets 91 and 101 include appropriate side bores 91A and 101A as best seen in FIG. 16. Thus, after pre-assembly of the brackets 91 and 101, the draw bolt 110 can be inserted through the holes 91A and 101A to prevent unwanted bowing of the side brackets 91 and 101.

Figure 17:
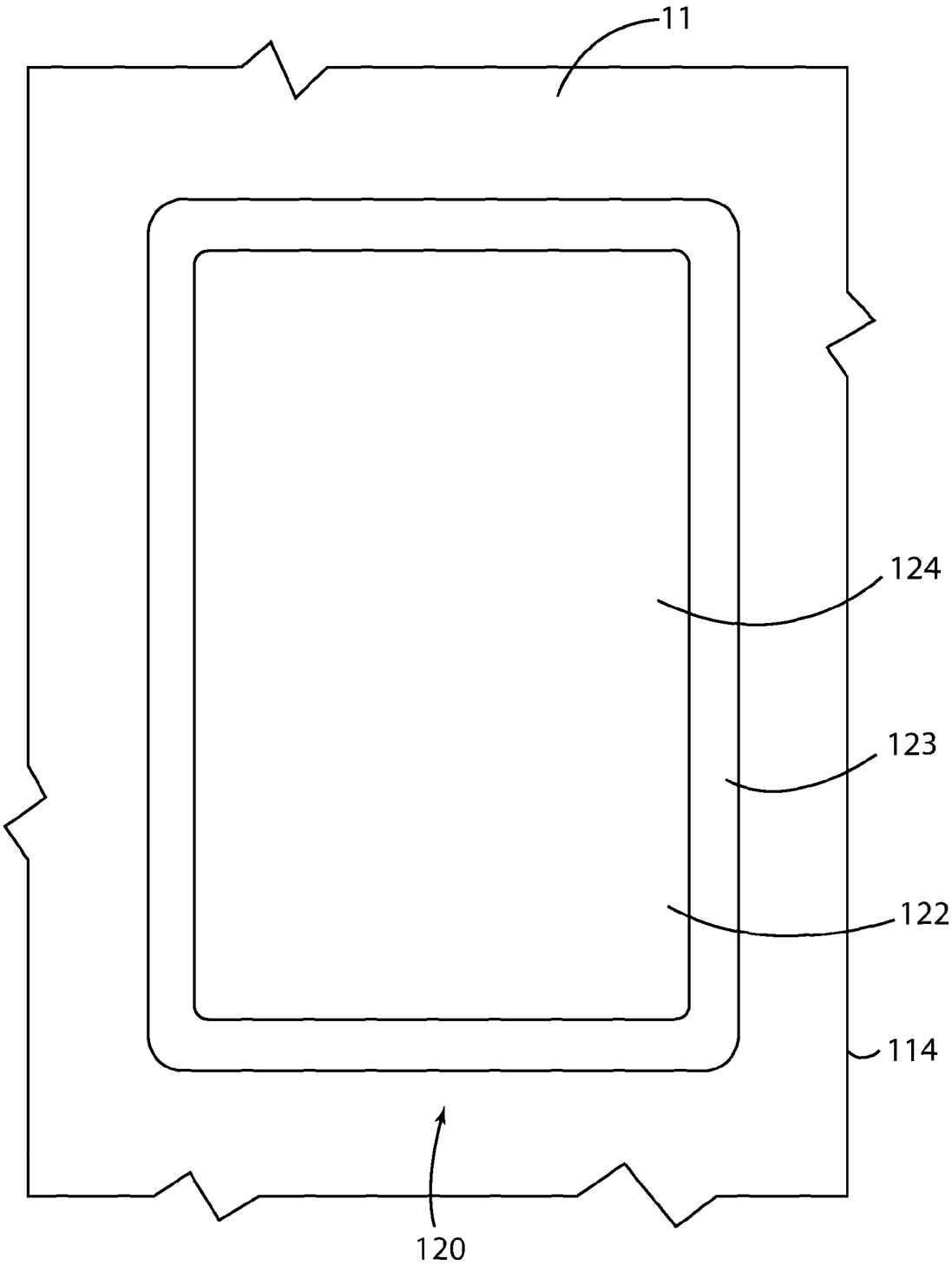
FIG. 17 is an enlarged front view of the door and a frameless window.

Next, referring to FIGS. 17-19, the door 11 also includes an improved construction having a flush-mounted window 120. The window 120 comprises two sheets 121 of a glass-like material such as plexiglass which each have a window face 122 that lies substantially flush with the door faces 11A. Known window constructions for these types of traffic doors typically have an obtrusive frame or gasket by which the glass sheets are mounted to the door, wherein the inventive window eliminates these frames and gaskets.

The improved window construction uses two opposed window sheets 121 which are shown in a generally rectangular shape. The window sheets 121 have a uniform thickness, but are provided with an opaque border 123, such as a black border, which extends partly into the window area as a marginal edge portion. The central portion of each if the sheets 121 defines a see-through or transluscent window section 124 which is bounded by the opaque border. Preferably, the border 123 is formed from coloration of the window sheet 121 and does not use a separate frame structure. As such, the surface of the window sheets 121 is substantially uniform as seen in FIG. 19 and is substantial flush with the door face 11A. This provides a clean, aesthetically pleasing appearance to the window 122 that avoids any use of separate frames, particularly a frame that projects obtrusively outwardly from the door face 11*a*.

To mount the window sheets 121, the door 11 is preferably formed of a door panel have a solid thickness formed of a machinable or modifiable material. The door panel also could be formed of a composite structure defined by multiple layers. The door cross section is shown in FIG. 19, wherein the door material first has a window opening 130 cut out of it. The window opening 130 has a peripheral edge 131 defining a flat edge face 132. Preferably, the edge 131 is machined to define two edge recesses 134 and 135 that have a rectangular shape defined by a bottom face 136 and side face 137. The side face 137 extends continuously about the outside of the window opening 130 and is dimensioned to snugly receive the window sheet edges there against. The depth of the recesses 134 and 135 are about the thickness of the window sheets 121 so that the window sheets 121 lie flush with the door face 11*a* when the window sheets 121 are pressed into the window opening 130.

While the snug fit may help hold the window sheets 121 in place, preferably a joining material 140 is provided such as an adhesive, tape or the like which is shown in FIG. 19 on the bottom faces 136. However, the joining material 140 can be provided on both faces 136 and 137 or one or the other to generate a clean appearance to the joint. Preferably, the opaque window border 123 extends face-wise inwardly beyond the recesses 134 and 135 to hide the machined door material and any joining material 140. Further, the inside edge face 132 is colored or finished with a material such as paint that preferably matches the color of the border 123 or otherwise provides an aesthetically pleasing appearance.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A hinge assembly for a self-closing, bidirectionally swinging door which is swingable between an open position and a normally closed position, said hinge assembly comprising:

a frame-mountable first bracket assembly comprising a frame bracket mountable on a door frame proximate an upper portion of said door, and a hinge pin projecting vertically downwardly from said frame bracket, said hinge pin defining a vertically extending pivot axis for said door and having a bottom end and a support head which defines an upward-facing, annular support ledge for rotatably supporting said door, said support ledge including support notches on opposite sides of said hinge pin;

a door-mountable second bracket assembly which is mountable to said door for suspending the door from said first bracket assembly for swinging rotation about said pivot axis, said second bracket assembly including rollers which are rotatable about a horizontally extending roller axis and are vertically supported on said support ledge of said hinge pin, said support notches receiving said rollers therein to rotationally bias said second bracket assembly to a first position corresponding to the closed position of said door, said second bracket assembly being displaceable vertically relative to said hinge pin wherein vertical displacement of said bracket assembly permits said rollers to move vertically out of said support notches during rotation of said second bracket assembly to a second position corresponding to the open position of said door supported by said second bracket assembly;

said second bracket assembly comprising first and second side brackets which each include a respective one of said rollers thereon, upper ends of said first and second side brackets each including a notch which align in opposing relation with each other to define a bore through which said hinge pin extends, said first and second side brackets being formed separate and positioned separately next to said hinge pin with said notches capturing said hinge pin therebetween with said rollers being positioned vertically on said support ledge, said first and second side brackets being secured together so that said second bracket assembly is rotatably and vertically supported in engagement with said first bracket assembly;

said second bracket assembly includes a door bracket which is mountable to said door separate from said first and second side brackets;

said first and second side brackets include a support plate which is releasably engageable with said door bracket; and said door bracket is displaceable onto flanges of said support plate to a support position for suspending said door on said first and second side brackets.

2. The hinge assembly according to claim 1, wherein each said roller is supported on a roller shaft on a respective one of said first and second side brackets which permits rotation of said roller relative to said hinge pin about said roller axis.

3. The hinge assembly according to claim 1, wherein said first and second side brackets are assembled to said first bracket assembly prior to suspension of said door from said second bracket assembly.

4. The hinge assembly according to claim 1, wherein fasteners are provided to fixedly secure said door bracket and said support plate together, said fasteners being engageable with said support plate and said door bracket after said door bracket is positioned in said support position.

5. The hinge assembly according to claim 1, wherein said door bracket is mountable to a side face of said door.

6. The hinge assembly according to claim 5, wherein said door bracket has a C-shape defining upper support flanges and a space therebetween, said support flanges being positioned vertically on said support plate and said first and second side brackets projecting upwardly through said space for engagement with said hinge pin.

7. A door assembly including a hinge assembly for a bidirectionally swinging door which is swingable between an open position and a normally closed position, said hinge assembly comprising:

a frame-mountable first bracket assembly comprising a frame bracket mountable on a door frame proximate an upper portion of said door, and a hinge pin projecting vertically downwardly from said frame bracket, said hinge pin defining a vertically extending pivot axis for said door and having a bottom end and a support head which defines an upward-facing, annular support ledge for rotatably supporting said door, said support ledge including support notches on opposite sides of said hinge pin;

a door-mountable second bracket assembly which is mountable to said door for suspending the door from said first bracket assembly for swinging rotation about said pivot axis, said second bracket assembly including rollers which are rotatable about a horizontally extending roller axis and are vertically supported on said support ledge of said hinge pin, said support notches receiving said rollers therein to rotationally bias said second bracket assembly to a first position corresponding to the closed position of said door, said second bracket assembly being displaceable vertically relative to said hinge in wherein vertical displacement of said bracket assembly permits said rollers to move vertically out of said support notches during rotation of said second bracket assembly to a second position corresponding to the open position of said door supported by said second bracket assembly;

said second bracket assembly comprising first and second side brackets which each include a respective one of said rollers thereon, upper ends of said first and second side brackets each including a notch which align in opposing relation with each other to define a bore through which said hinge pin extends, said first and second side brackets being formed separate and positioned separately next to said hinge pin with said notches capturing said hinge pin therebetween with said rollers being positioned vertically on said support ledge, said first and second side brackets being secured together so that said second bracket assembly is rotatably and vertically supported in engagement with said first bracket assembly; and said second bracket assembly including a door bracket which is mounted to a door panel separate from said first and second side brackets, and said first and second side brackets including a support plate which is releasably engageable with said door bracket, said door bracket being displaceable onto flanges of said support plate to a support position for suspending said door panel on said first and second side brackets after said first and second side brackets are pre-assembled onto and supported on said hinge pin.

8. The door assembly according to claim 7, wherein each said roller is supported on a roller shaft on a respective one of said first and second side brackets which permits rotation of said roller relative to said hinge pin about said roller axis.

9. The door assembly according to claim 7, wherein said first and second side brackets are assembled together and rotatably secured to said first bracket assembly, and said door bracket is pre-mounted on said door panel prior to suspension of said door panel from said first and second side brackets.

10. The door assembly according to claim 9, wherein fasteners are provided to fixedly secure said door bracket and said support plate together, said fasteners being engageable with said support plate and said door bracket after said door bracket is positioned in said support position.

11. The door assembly according to claim 10, wherein said support plate is formed on a bottom end of said first side bracket.

12. The door assembly according to claim 11, wherein said second side bracket includes a fastener at a lower end thereof which is affixed to said support plate after said first and second side brackets are suspended from said hinge pin.

13. The door assembly according to claim 7, wherein a drawing member is provided for drawing said first and second side brackets sidewardly together to capture said hinge pin between said notches.

14. The door assembly according to claim 7, wherein said door bracket is mountable to a side face of said door panel and said hinge pin is disposed sidewardly adjacent to said side face.

15. The door assembly according to claim 14, wherein said door bracket has a C-shape defining upper support flanges and a space therebetween, said support flanges being positioned vertically on said support plate and said first and second side brackets projecting upwardly through said space for engagement with said hinge pin.

16. The door assembly according to claim 7, wherein said door bracket has a C-shape defining upper support flanges and a space therebetween, said support flanges being positioned vertically on said support plate and said first and second side brackets projecting upwardly through said space for engagement with said hinge pin.

* * * * *